US011167943B2

(12) United States Patent
Mitsui

(10) Patent No.: US 11,167,943 B2
(45) Date of Patent: Nov. 9, 2021

(54) SHEET FEEDING APPARATUS AND IMAGE FORMING APPARATUS

(71) Applicant: CANON KABUSHIKI KAISHA, Tokyo (JP)

(72) Inventor: Yuji Mitsui, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/789,632

(22) Filed: Feb. 13, 2020

(65) Prior Publication Data

US 2020/0283248 A1 Sep. 10, 2020

(30) Foreign Application Priority Data

Mar. 6, 2019 (JP) ..... JP2019-040904

(51) Int. Cl.
*B65H 1/00* (2006.01)
*B65H 1/04* (2006.01)

(52) U.S. Cl.
CPC ..... *B65H 1/04* (2013.01)

(58) Field of Classification Search
CPC ..... B65H 1/00; B65H 2405/00; B65H 2405/1116; B65H 2405/112; B65H 2405/113; B65H 2405/114; B65H 2511/10; B65H 2511/12; B65H 2701/1131; B65H 1/04
See application file for complete search history.

(56) References Cited

U.S. PATENT DOCUMENTS 5,333,852 A * 8/1994 Milillo ..... B65H 1/04 271/171
6,070,048 A * 5/2000 Nonaka ..... B65H 1/00 399/376
6,254,085 B1 * 7/2001 Kang ..... B65H 1/266 271/171
8,584,371 B2 * 11/2013 Marumoto ..... B65H 1/266 33/555
9,434,560 B2 * 9/2016 Okada ..... B65H 1/04
9,499,366 B2 * 11/2016 Morikami ..... B65H 1/266

FOREIGN PATENT DOCUMENTS

JP H11-130271 A 5/1999
JP 2006-062142 A 3/2006
JP 2006-256839 A 9/2006
JP 2015-006939 A 1/2015

* cited by examiner

*Primary Examiner* — Thomas A Morrison
(74) *Attorney, Agent, or Firm* — Venable LLP

(57) ABSTRACT

A sheet feeding apparatus includes a supporting portion, a regulating unit supported to be movable in a first direction, a feed unit, a variable resistor including a rotary member configured to be rotated by a movement of the regulating unit in the first direction, and having a resistance value changing according to a rotational phase of the rotary member, an interlocking portion configured to rotate the rotary member in conjunction with the regulating unit, and a substrate including a pattern surface to which the variable resistor is connected. An axial center line of the rotary member extends in a second direction orthogonal to the first direction and a direction of gravitational force. The substrate is disposed such that the pattern surface extends in parallel with the first direction and the direction of gravitational force.

7 Claims, 17 Drawing Sheets

SHEET FEEDING APPARATUS AND IMAGE FORMING APPARATUS

BACKGROUND OF THE INVENTION

Field of the Invention

The present invention relates to a sheet feeding apparatus that feeds a sheet and an image forming apparatus including the sheet feeding apparatus.

Description of the Related Art

In recent years, various sizes of sheets are used in an image forming apparatus such as a copier and a printer, and the apparatus equipped with a sensor for determining a size of the sheet is known. Hitherto, a sheet size detection apparatus including a width regulation member regulating a position in a width direction of the sheet stacked on a document sheet feed tray, a printed substrate placed inside the document sheet feed tray, and an elastic contact attached to a rack portion of the width regulation member is proposed (refer to JP-A-2015-6939). A sheet size identification pattern is formed on an upper surface of the printed substrate, and different electrical signals are transmitted according to the position where the elastic contact and the sheet size identification pattern come into contact. A control portion of the sheet size detection apparatus identifies a document size based on a transmitted electrical signal.

However, the sheet size detection apparatus described in JP-A-2015-6939 has the sheet size identification pattern on the printed substrate facing upward, and an installation area of the sheet size detection apparatus in a plan view is large. In addition, in the case where dust or fluff falls on the sheet size identification pattern from above, these are likely to adhere and there is a possibility that the sheet size is erroneously detected.

SUMMARY OF THE INVENTION

According to a first aspect of the present invention, a sheet feeding apparatus includes a supporting portion configured to support a sheet, a regulating unit supported to be movable in a first direction, and configured to regulate a position of an end portion, in the first direction, of the sheet supported by the supporting portion, a feed unit configured to feed the sheet supported by the supporting portion, a variable resistor including a rotary member configured to be rotated by a movement of the regulating unit in the first direction, and having a resistance value changing according to a rotational phase of the rotary member, an interlocking portion configured to rotate the rotary member in conjunction with the regulating unit, and a substrate including a pattern surface to which the variable resistor is connected. An axial center line of the rotary member extends in a second direction orthogonal to the first direction and a direction of gravitational force. The substrate is disposed such that the pattern surface extends in parallel with the first direction and the direction of gravitational force.

According to a second aspect of the present invention, a sheet feeding apparatus includes a supporting portion configured to support a sheet, a regulating unit supported to be movable in a first direction, and configured to regulate a position of an end portion, in the first direction, of the sheet supported by the supporting portion, a feed unit configured to feed the sheet supported by the supporting portion, a sensor including a moving unit configured to move in the first direction by a movement of the regulating unit in the first direction, and having a detection value changing according to a position of the moving unit in the first direction, an interlocking portion configured to move the moving unit in the first direction in conjunction with the regulating unit, and a substrate including a pattern surface to which the sensor is connected. The substrate is disposed such that the pattern surface extends in parallel with the first direction and a direction of gravitational force.

Further features of the present invention will become apparent from the following description of exemplary embodiments with reference to the attached drawings.

DESCRIPTION OF THE EMBODIMENTS

Exemplary embodiments for performing the present invention will be described below with reference to the drawings. However, dimensions, materials, shapes, and relative dispositions of components described in the embodiments need to be appropriately changed according to the configuration of the apparatus to which the invention is applied and various conditions. That is, it is not intended to limit the scope of the present invention to the following embodiments.

First Embodiment

Overall Configuration

Figure 1:
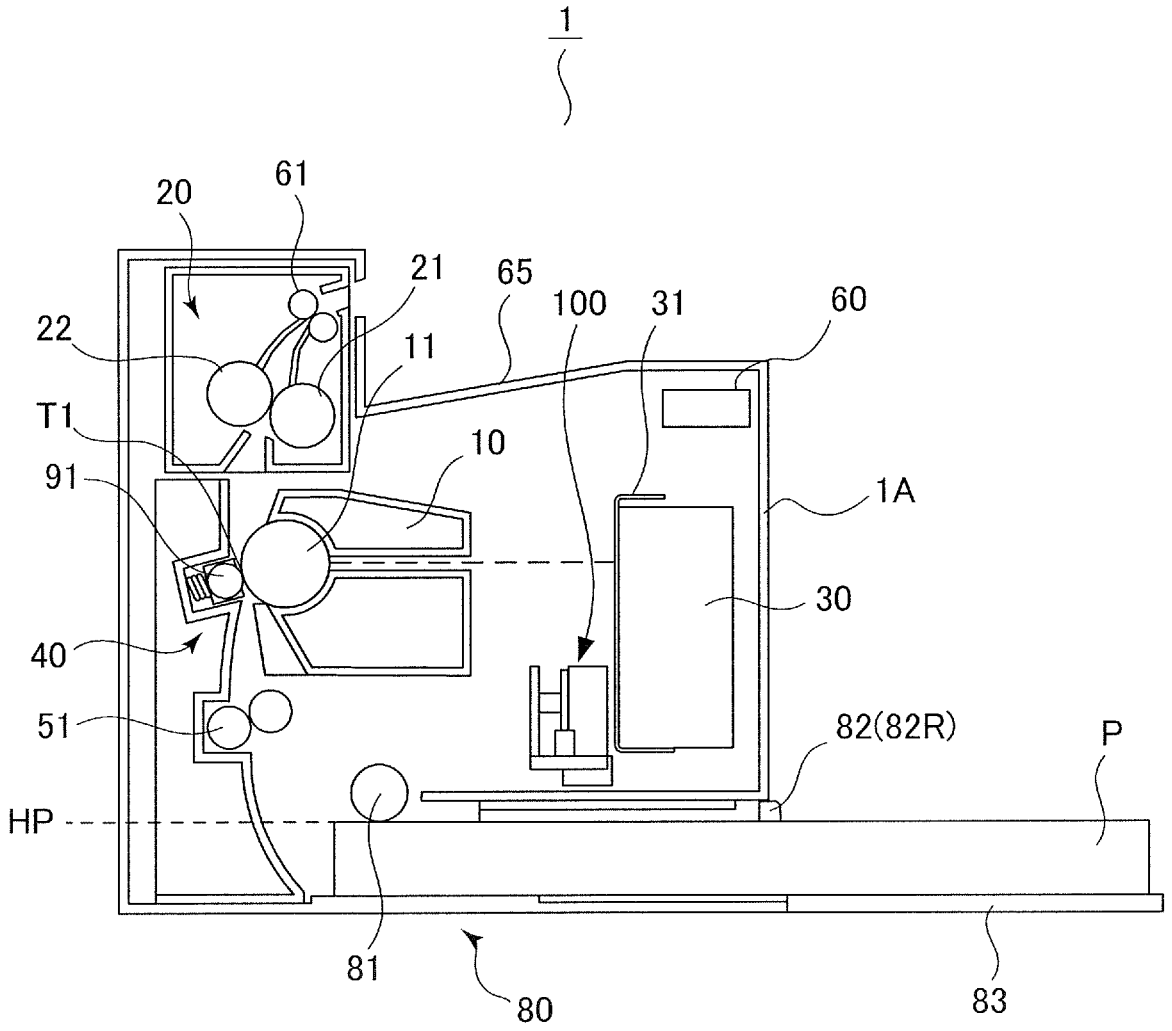
FIG. 1 is an overall schematic diagram illustrating a printer according to a first embodiment.
Figure 2A:
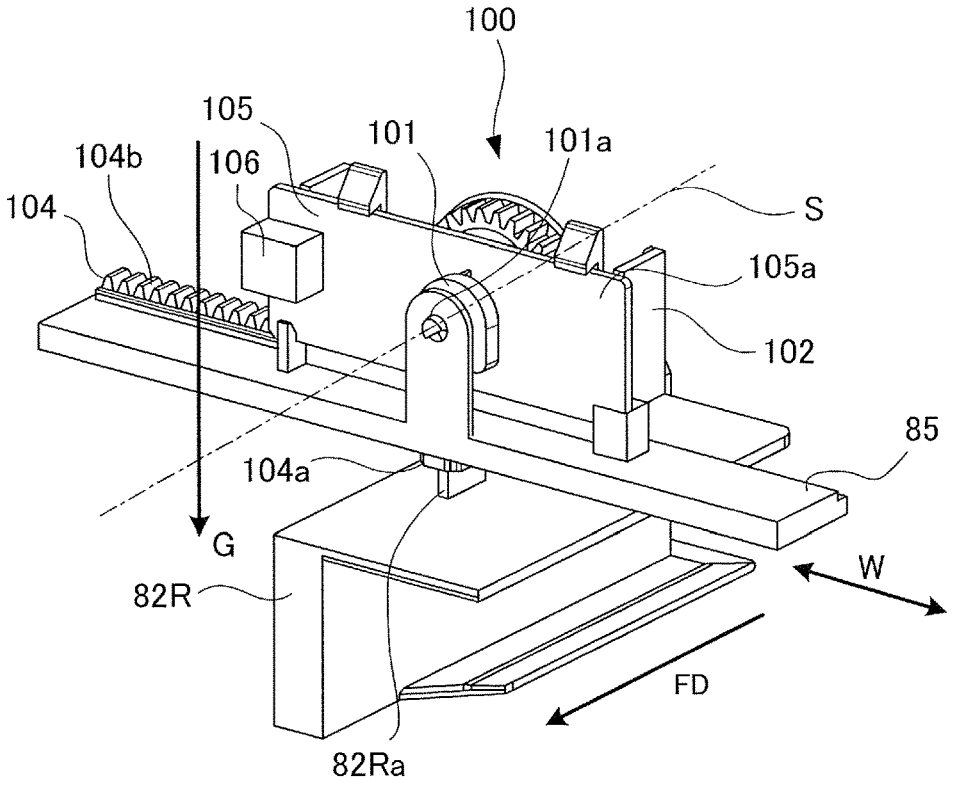
FIG. 2A is a front perspective view illustrating a detection unit.
Figure 2B:
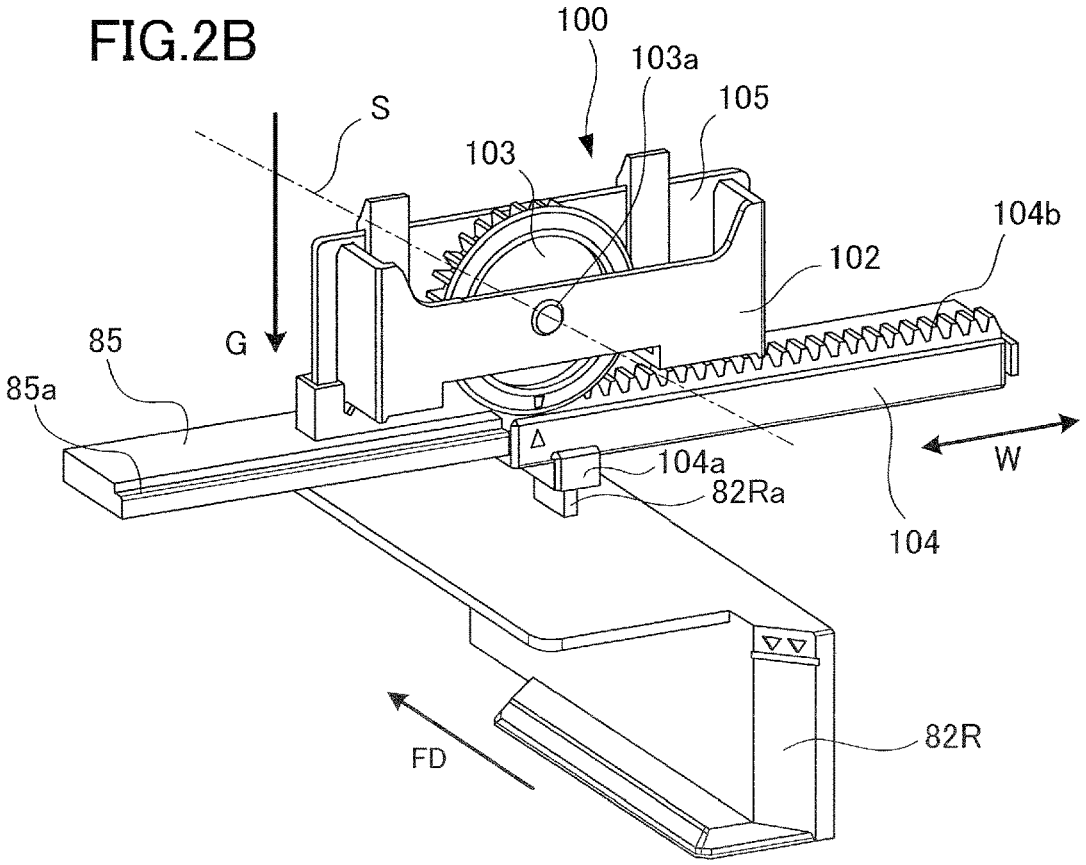
FIG. 2B is a rear perspective view illustrating the detection unit.

A printer 1 as an image forming apparatus according to a first embodiment is an electrophotographic system laser beam printer forming a monochrome toner image. As illustrated in FIG. 1, the printer 1 includes a sheet feeding apparatus 80 feeding a sheet, an image forming unit 40 forming an image on a fed sheet, a fixing unit 20, a sheet discharge roller pair 61, and a control portion 60. The control portion 60 includes a CPU, a ROM, and a RAM (not illustrated).

When an image formation command is output to the printer 1, an image forming process by the image forming unit 40 is started based on image information input from an external computer or the like connected to the printer 1. The image forming unit 40 includes a process cartridge 10, a laser scanner 30 fixed to a scanner frame 31, and a transfer roller 91.

The process cartridge 10 includes a rotatable photosensitive drum 11, and a charging roller, a developing roller, and a cleaning blade (not illustrated) disposed along the photosensitive drum 11. The transfer roller 91 and the photosensitive drum 11 form a transfer nip T1. It is noted that in the present embodiment, the printer 1 is a monochrome laser beam printer, and is not limited thereto. For example, the printer 1 may be a full-color laser beam printer.

The laser scanner 30 irradiates the photosensitive drum 11 with laser light based on the input image information. At this time, the photosensitive drum 11 is previously charged by the charging roller, and an electrostatic latent image is formed on the photosensitive drum 11 when irradiated with laser light. Thereafter, the electrostatic latent image is developed by the developing roller, and a monochrome toner image is formed on the photosensitive drum 11.

In parallel with the image forming process described above, the sheet is fed from the sheet feeding apparatus 80. The sheet feeding apparatus 80 includes a sheet feed tray 83 as a supporting portion supported by a printer body 1A so as to be openable and closable, a pickup roller 81 as a feed unit, a pair of side regulating plates 82, and a detection unit 100. The sheet feed tray 83 forms a portion of an exterior of a front surface of the printer body 1A in a closed state, and a user can access a sheet storage space inside the printer body 1A by being in an open state. It is noted that the sheet feed tray 83 may not be configured to pivot, and may be configured to slide to be accommodated in and withdrawn from the printer body 1A.

In response to the image formation command, the pickup roller 81 rotates and a sheet P supported by the sheet feed tray 83 is fed by the pickup roller 81. The sheets P fed by the pickup roller 81 are separated one by one by a separation mechanism (not illustrated). It is noted that the sheet P may be fed by a belt or the like instead of the pickup roller 81.

The sheets P separated one by one are conveyed to a registration roller pair 51, and skew feeding is corrected by the registration roller pair 51. The toner image on the photosensitive drum 11 is transferred to the sheet P conveyed by the registration roller pair 51 at a predetermined conveyance timing by the electrostatic load bias applied to the transfer roller 91 at the transfer nip T1. Residual toner remaining on the photosensitive drum 11 is collected by a cleaning blade.

Predetermined heat and pressure are applied to the sheet P to which the toner image is transferred by a heating roller 21 and a pressing roller 22 of the fixing unit 20, and the toner is melted and fixed. The sheet passed through the fixing unit 20 is discharged to a sheet discharge tray 65 by the sheet discharge roller pair 61.

Configuration of Detection Unit

Next, a configuration of the detection unit 100 will be described in detail. As illustrated in FIGS. 2A to 5, the detection unit 100 includes a slider 104, a sensor gear 103, a printed substrate 105, and a size detection sensor 101. It is noted that the slider 104 is attached to one of a pair of side regulating plates 82, and the pair of side regulating plates 82 are configured to be interlocked with each other in a width direction W toward or away from each other by a rack and pinion (not illustrated). In the present embodiment, the slider 104 is attached to a side regulating plate 82R as a regulating unit, and the slider 104 may be attached to the other side regulating plate 82L (refer to FIG. 6) of the pair of side regulating plates 82.

A protruding portion 82Ra protruding upward is formed on the upper portion of the side regulating plate 82R, and the protruding portion 82Ra is engaged with an engagement portion 104*a* protruding downward from the lower portion of the slider 104. The slider 104 is configured to be slidable in the width direction W along a guide rail 85*a* formed on a feeding frame 85. That is, the slider 104 is configured to be interlocked with the movement in the width direction W serving as a first direction of the side regulating plate 82R.

In addition, a holder 102 is fixed to the feeding frame 85, and the printed substrate 105 is mounted on the holder 102 in a portrait orientation. That is, the printed substrate 105 serving as a substrate is disposed so that a pattern surface 105*a* extends in parallel with the width direction W and a direction of gravitational force G The size detection sensor 101 is attached to the pattern surface 105*a* in an electrically connected state. Not only the pattern surface 105*a* is attached with electrical components such as the size detection sensor 101 and a connector 106, but also a pattern disposition and a predetermined area are necessary.

The size detection sensor 101 serving as a sensor is a rotary variable resistor, and includes a sensor body 101*b*, and a shaft member 101*a* rotatably supported by the sensor body 101*b* and the feeding frame 85. The shaft member 101*a* extends parallel to a sheet feeding direction FD. A resistor (not illustrated) is disposed inside the sensor body 101*b*, and a resistance value of the resistor changes according to an angle of the shaft member 101*a*. The size detection sensor 101 detects the resistance value serving as a detection value by converting the detection value into a voltage, and the control portion 60 (refer to FIG. 1) determines the size of the sheet P according to a detected voltage.

Figure 3:
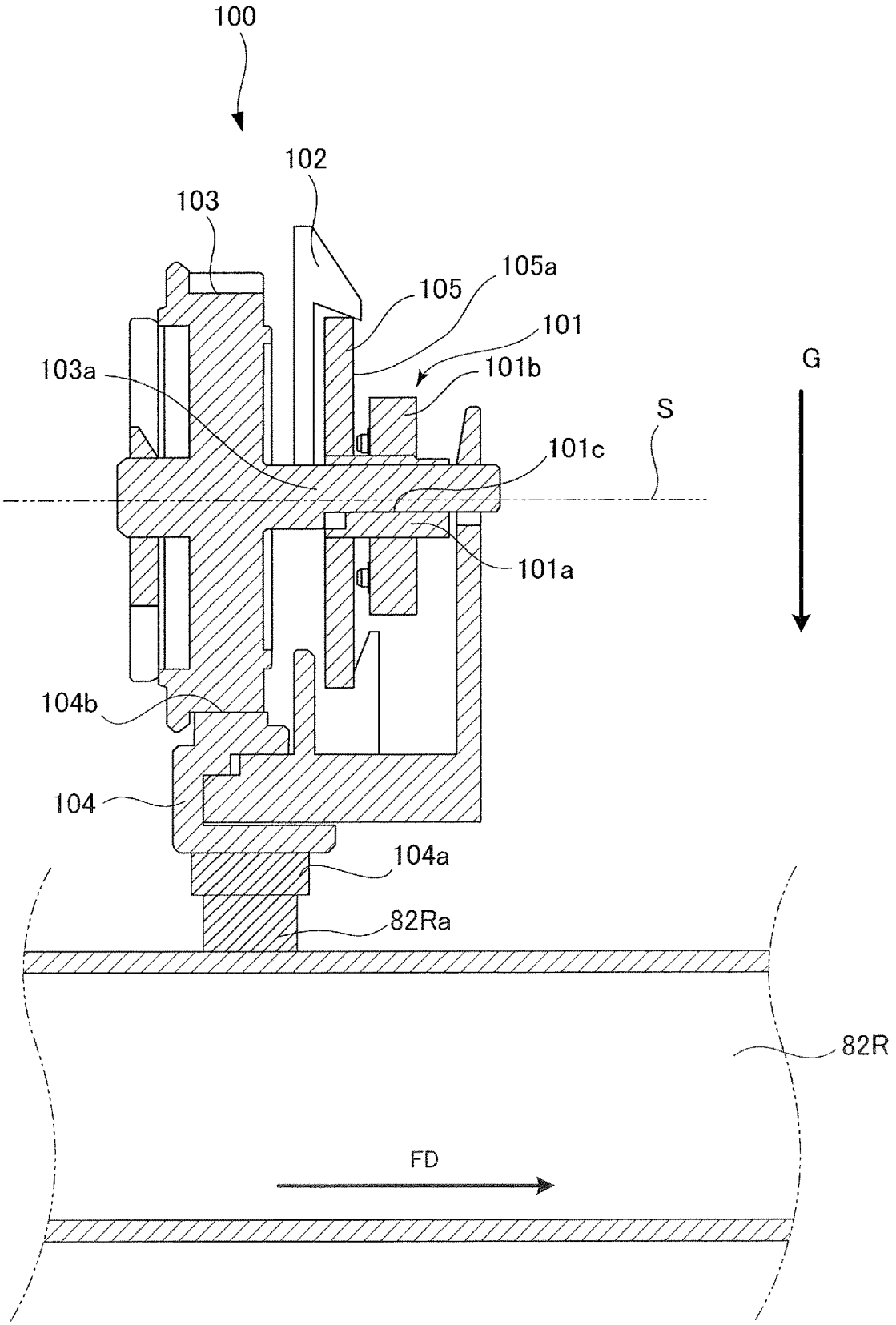
FIG. 3 is a cross-sectional view illustrating the detection unit.
Figure 4:
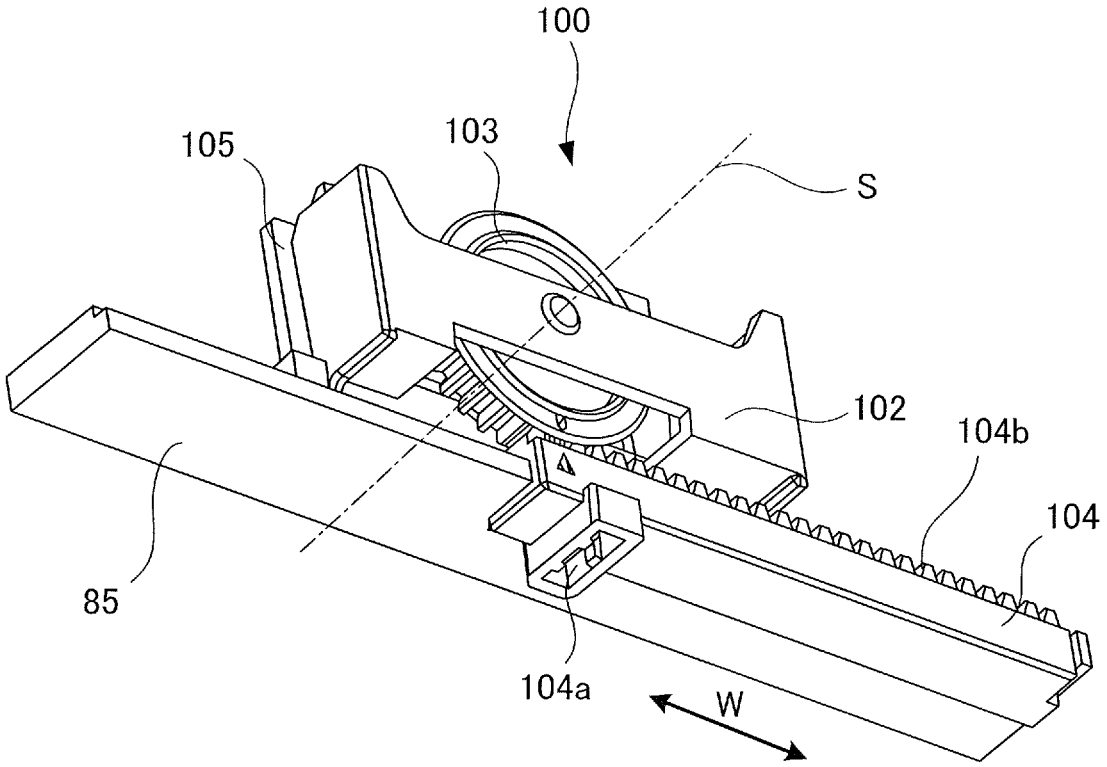
FIG. 4 is a bottom perspective view illustrating the detection unit.
Figure 5:
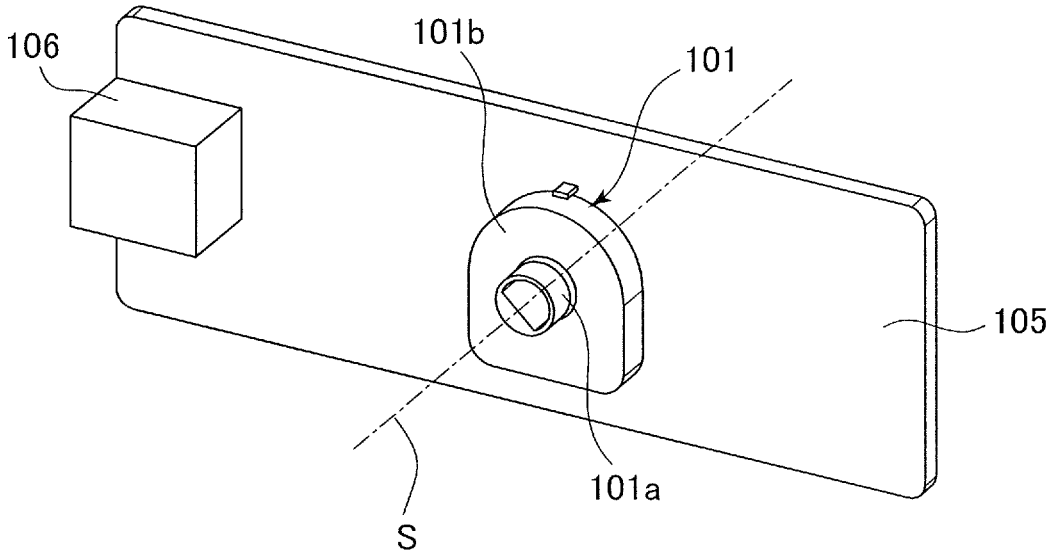
FIG. 5 is a perspective view illustrating a size detection sensor.

As illustrated in FIG. 3, a hole 101*c* is formed in the shaft member 101*a* serving as a rotary member, and a rotation shaft 103*a* of the sensor gear 103 is fitted into the hole 101*c*. The shaft member 101*a* and the rotation shaft 103*a* are provided so as to penetrate the printed substrate 105. The rotation shaft 103*a* is rotatably supported by the holder 102, and the sensor gear 103 serving as a gear portion meshes with a rack portion 104*b* formed on the slider 104 and extending in the width direction W. An axial center line S of the shaft member 101*a* and the rotation shaft 103*a* extends in a direction orthogonal to the width direction W and the direction of gravitational force G that is, the sheet feeding direction FD serving as a second direction. As described above, the size detection sensor 101, the sensor gear 103, and the printed substrate 105 are disposed in a portrait orientation so that the installation area in a plan view is small.

Furthermore, the detection unit 100 is disposed above the sheet feed tray 83 in the open state, and more specifically, is disposed above an abutting position HP (refer to FIG. 1) where the sheet P supported by the sheet feed tray 83 and the pickup roller 81 abut each other. Mainly, since foreign substances such as dust, fluff, paper dust, and fillers generated from the sheet P and the pickup roller 81 fall below the abutting position HP, the foreign substances are unlikely to enter a gap between the printed substrate 105 and the shaft member 101*a*. In addition, since the sensor gear 103 and the printed substrate 105 are placed in a portrait orientation, the structure is such that the foreign substances are unlikely to enter the gap. As a result, it can reduce that the size detection sensor 101 detects erroneously by the influence of the foreign substances.

Operation of Side Regulating Plate and Detection Unit

Figure 6:
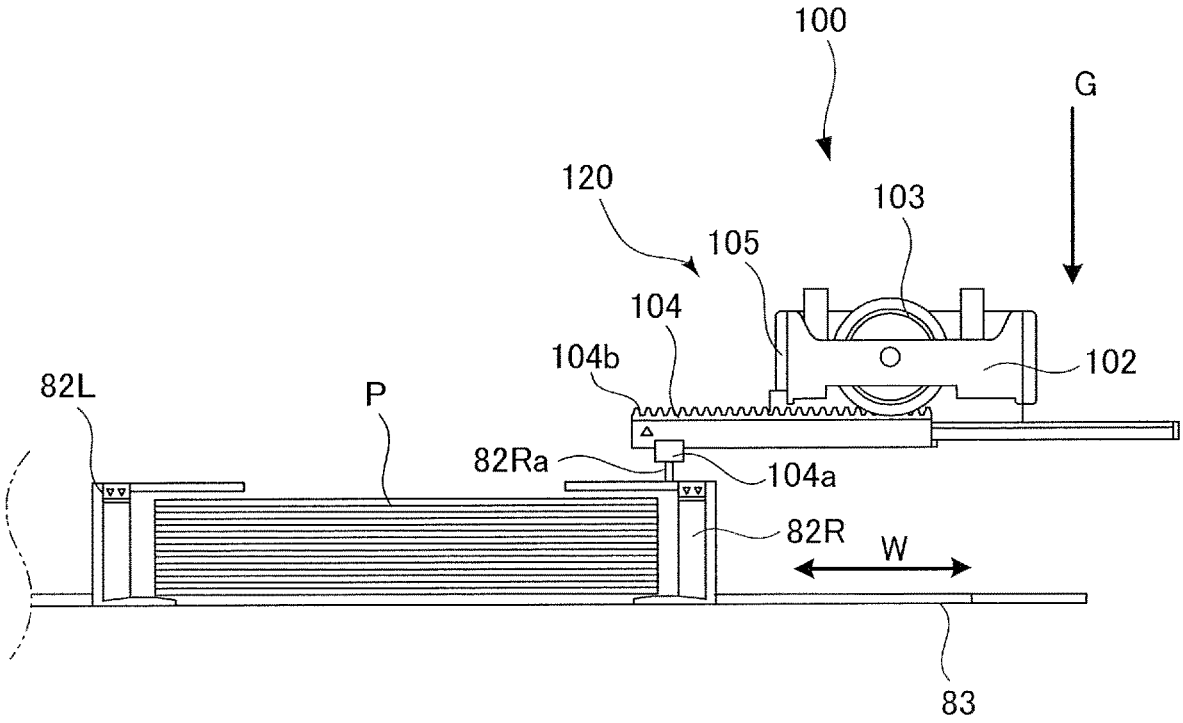
FIG. 6 is a side view illustrating an operation of a side regulating plate and the detection unit.

Next, the operation of the side regulating plate 82R and the detection unit 100 will be described. First, as illustrated in FIG. 6, the user sets the sheet P on the sheet feed tray 83 and moves the side regulating plate 82R in the width direction W to regulate a position of an end portion of the sheet P in the width direction W. At this time, by moving one side regulating plate 82R, the other side regulating plate is also interlocked, so that the positions of both end portions in the width direction W of the sheet P are regulated.

When the side regulating plate 82R moves in the width direction W, the slider 104 connected to the side regulating plate 82R also moves in the width direction W. The sensor gear 103 rotates by the rack portion 104*b* formed in the slider 104, and the shaft member 101*a* fitted into the rotation shaft 103*a* of the sensor gear 103 also rotates. As described above, the slider 104 and the sensor gear 103 constitute an interlocking portion 120 that rotates the shaft member 101*a* in conjunction with the side regulating plate 82R.

The size detection sensor 101 converts a resistance value that changes according to a rotational phase of the shaft member 101*a* into a voltage, and the detected voltage is recognized as a size in the width direction of the sheet P (hereinafter referred to as width size) by the control portion 60.

Figure 7:
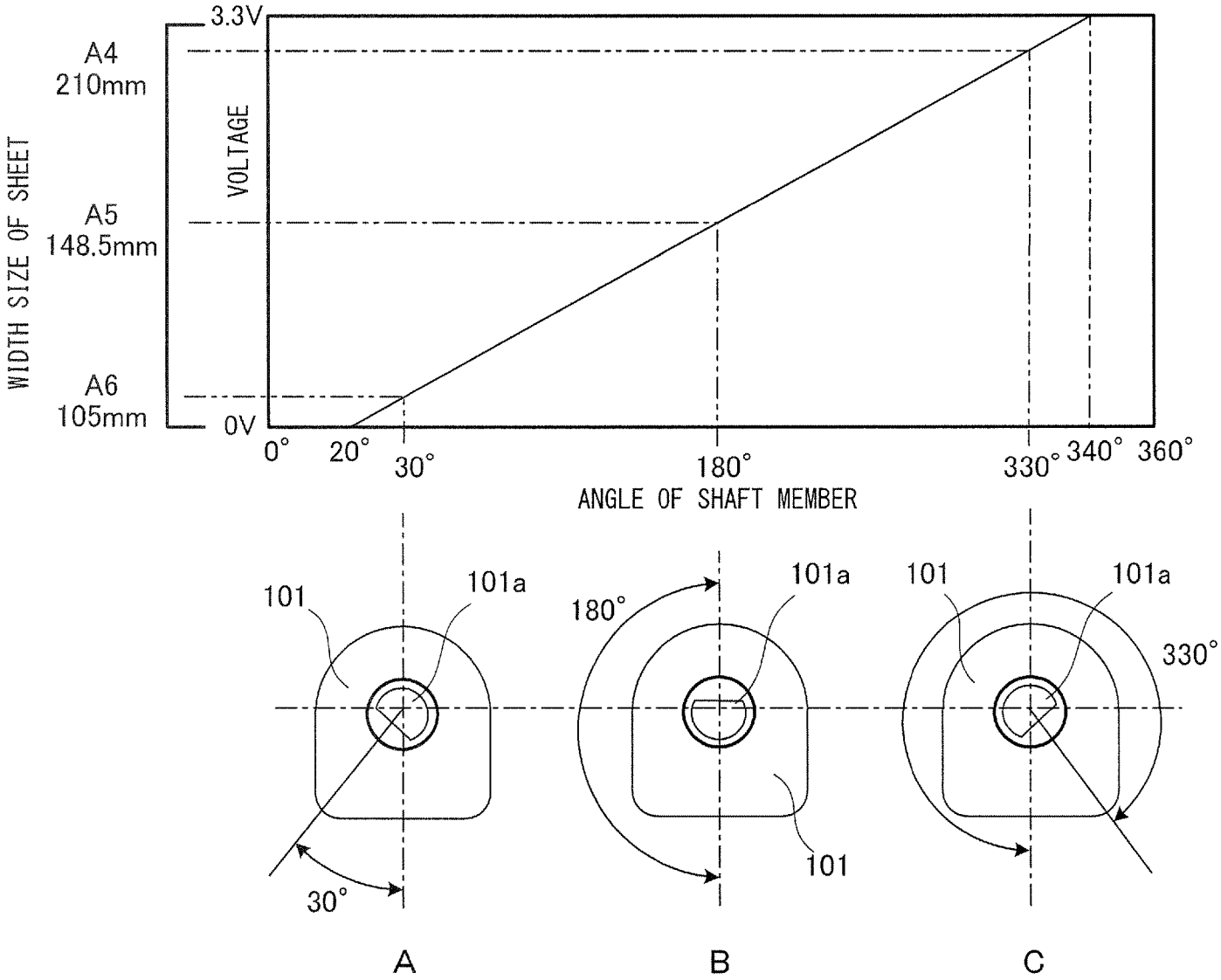
FIG. 7 is a graph illustrating a relationship between an angle of a shaft member and a width size of a sheet.

FIG. 7 is a graph illustrating a relationship between an angle of the shaft member 101*a* and the width size of the sheet P. A horizontal axis of the graph indicates a rotation angle from a reference position of the shaft member 101*a*, and a vertical axis indicates a voltage and the width size of the sheet P corresponding to the voltage. As the rotation angle of the shaft member 101*a* increases, the voltage increases proportionally. Therefore, the size detection sensor 101 can detect a sheet width linearly.

Here, in a condition in which the shaft member 101*a* is in an A position, that is, when the rotation angle is 30°, the width size of the detected sheet P is set to be equivalent to an A6 size (105 mm). When the shaft member 101*a* is in a B position, that is, in a condition in which the rotation angle is 180°, the width size of the detected sheet P is set to be equivalent to an A5 size (148.5 mm). When the shaft member 101*a* is in a C position, that is, in a condition in which the rotation angle is 330°, the detected width size of the sheet P is set to be equivalent to an A4 size (210 mm).

It is noted that a voltage is not displayed when the rotation angle of the shaft member 101*a* is in the range of 0° to 20° and 340° to 360°. This is because the size detection sensor 101 is out of the usage area in terms of electrical characteristics. It is noted that the printer 1 according to the present embodiment supports sheets from A6 to A4, and a mechanical margin of 10° is provided for the rotation angle of the shaft member 101*a* corresponding to a minimum width size and a maximum width size.

Since the pair of side regulating plates 82 operate symmetrically, a moving amount N of the side regulating plate 82R is half of a value obtained by subtracting the minimum width size from the maximum width size that can be detected by the size detection sensor 101. In addition, the moving amount N corresponds to a moving amount of the slider 104.

Here, a pitch circumferential length of the sensor gear 103 is set to a value obtained by combining the moving amount N with an arc for an angle outside the use area in the electrical characteristics of the size detection sensor 101. For example, as set in FIG. 7, when the maximum width size is 210 mm of A4 size and the minimum width size is 105 mm of A6 size, the moving amount N is 52.5 mm. Since 300° which is the rotation angle of the sensor gear 103 corresponds to 52.5 mm, the pitch circumferential length of the sensor gear 103 is 63 mm or greater. In the case where a module of the sensor gear 103 is 1, the number of teeth is set to 21 or greater.

As described above, in the present embodiment, since the size detection sensor 101, the sensor gear 103, and the printed substrate 105 are disposed in a portrait orientation, the installation area of the detection unit 100 in a plan view can be reduced, and the apparatus can be downsized. It is noted that the portrait orientation of the size detection sensor 101 and the sensor gear 103 refers to a state in which the shaft member 101*a* of the size detection sensor 101 and the rotation shaft 103*a* of the sensor gear 103 extend in a direction orthogonal to the direction of gravitational force G. In the present embodiment, the direction orthogonal to the direction of gravitational force G corresponds to the sheet feeding direction FD. The portrait orientation of the printed substrate 105 refers to a state in which the pattern surface 105*a* is disposed so as to extend in parallel to the width direction W and the direction of gravitational force G.

Furthermore, the size detection sensor 101, the sensor gear 103, and the printed substrate 105 are placed in a portrait orientation, and the detection unit 100 is disposed above the sheet feed tray 83, so that the size detection sensor 101 can be prevented from making an erroneous detection due to the influence of foreign substances. In addition, since the size detection sensor 101 can detect the sheet width linearly, a fine sheet size can be detected and usability can be improved.

Second Embodiment

Next, a second embodiment of the present invention will be described. The second embodiment is configured by adding a plurality of gears for decelerating a driving force to the detection unit of the first embodiment. Therefore, a configuration similar to that of the first embodiment will not be illustrated or described with the same reference numerals in the drawings.

Configuration of Detection Unit

Figure 8:
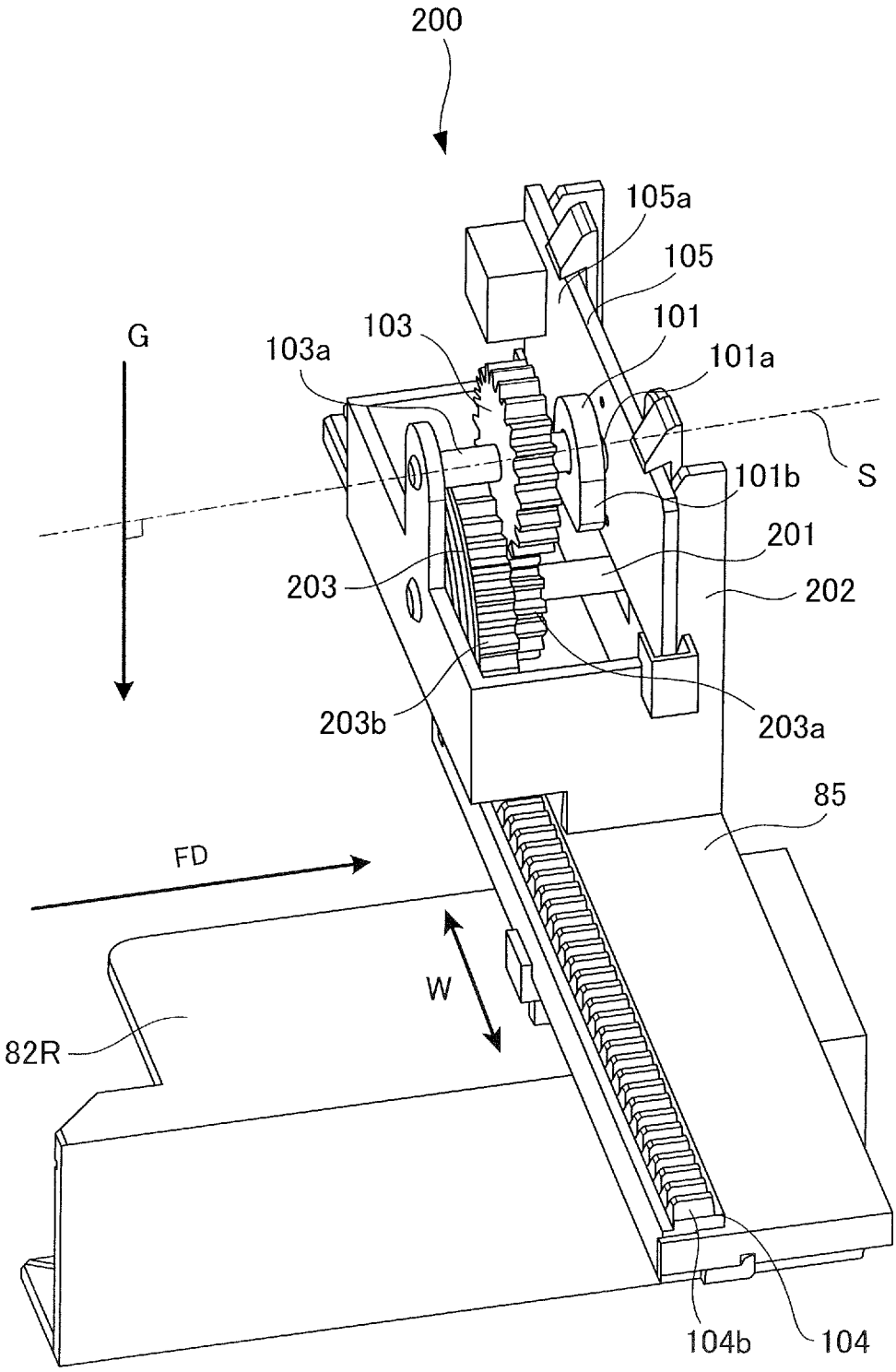
FIG. 8 is a perspective view illustrating a detection unit according to a second embodiment.

As illustrated in FIG. 8, a detection unit 200 includes a holder 202 fixed to the feeding frame 85, an idler shaft 201 rotatably supported by the holder 202, and an idler step gear 203 supported rotatably on the idler shaft 201. The idler step gear 203 includes a small diameter gear 203*a* and a large diameter gear 203*b* that rotate integrally with each other, and the large diameter gear 203*b* meshes with the rack portion 104*b* of the slider 104. The small diameter gear 203*a* meshes with the sensor gear 103.

Also in the present embodiment, similar to the first embodiment, the axial center line S of the shaft member 101*a* and the rotation shaft 103*a* extends in a direction orthogonal to the width direction W and the direction of gravitational force G That is, the axial center line S extends in the sheet feeding direction FD. In addition, the printed substrate 105 retained by the holder 202 is disposed so that the pattern surface 105*a* extends in parallel to the width direction W and the direction of gravitational force G That is, the size detection sensor 101, the sensor gear 103, and the printed substrate 105 are disposed in a portrait orientation, so that the installation area of the detection unit 200 in a plan view can be reduced, and the apparatus can be downsized.

Operation of Side Regulating Plate and Detection Unit

Figure 9:
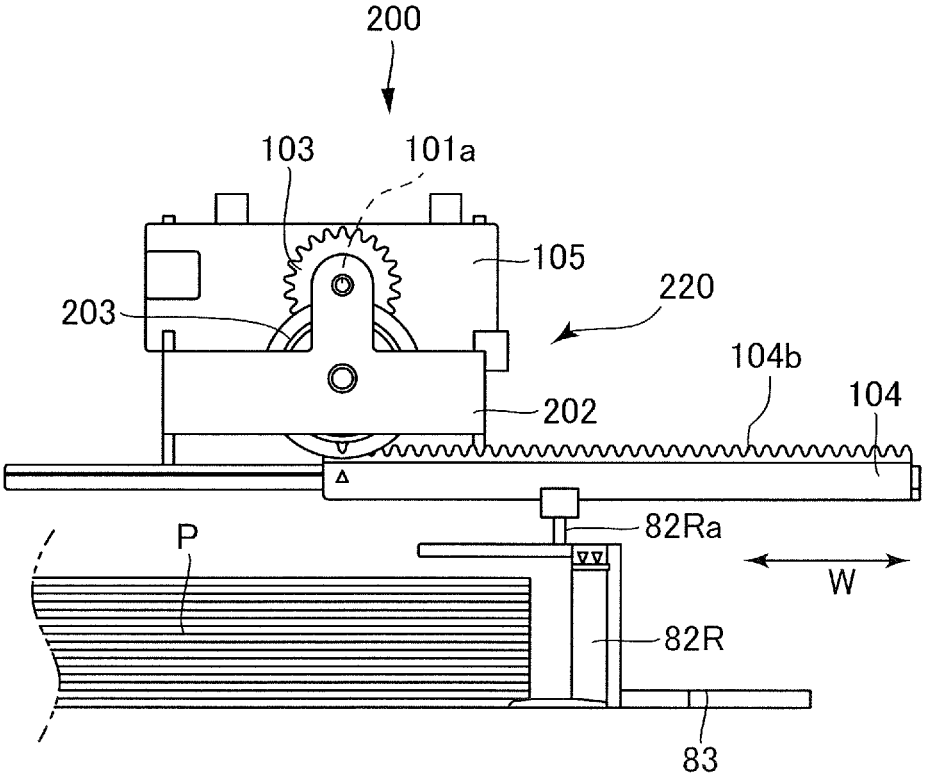
FIG. 9 is a side view illustrating an operation of a side regulating plate and the detection unit.

As illustrated in FIGS. 8 and 9, when the side regulating plate 82R moves in the width direction W, the slider 104 connected to the side regulating plate 82R also moves in the width direction W. The idler step gear 203 is rotated by the rack portion 104*b* formed in the slider 104, and the driving force is decelerated by the idler step gear 203 and transmitted to the sensor gear 103. That is, the idler step gear 203 serving as a gear portion includes the plurality of gears that decelerate the driving force transmitted from the rack portion 104*b* and transmit the driving force to the sensor gear 103.

When the sensor gear 103 rotates, the shaft member 101*a* fitted into the rotation shaft 103*a* of the sensor gear 103 also rotates. As described above, the slider 104, the idler step gear 203, and the sensor gear 103 constitute an interlocking portion 220 that rotates the shaft member 101*a* in conjunction with the side regulating plate 82R.

The size detection sensor 101 converts a resistance value that changes according to the rotational phase of the shaft member 101*a* into a voltage, and a detected voltage is recognized as a size in the width direction of the sheet P (hereinafter referred to as width size) by the control portion 60 (refer to FIG. 1).

For example, it is considered that a case where the maximum size of the sheet P that can be detected by the detection unit 200 is set to A1 size (width 594 mm) and the minimum size is set to postcard size (width 100 mm). In this case, the moving amount N of the side regulating plate 82R is 247 mm, and the number of teeth of the large diameter gear 203*b* of the idler step gear 203 is set to 46 and the number of teeth of the small diameter gear 203*a* is set to 13.

As described above, by setting the deceleration ratio of the idler step gear 203, the rotation amount of the sensor gear 103 can be reduced to approximately 69.81 mm, which is a gear ratio of the large diameter gear 203*b* and the small diameter gear 203*a* of the idler step gear 203. The pitch circumferential length of the sensor gear 103 is 85 mm or greater by adding an arc for an angle outside the use area in the electrical characteristics of the size detection sensor 101 to approximately 69.81 mm which is the rotation amount of the sensor gear 103. In the case where the module of the sensor gear 103 is 1, the number of teeth is set to 27 or greater.

As described above, the idler step gear 203 is disposed in a drive train between the slider 104 and the sensor gear 103. Therefore, even when the moving amount N of the side regulating plate 82R is increased, the increase in size of the sensor gear 103 can be suppressed. As a result, the detection unit 200 can be downsized and the apparatus can be downsized while the range of detectable sheet sizes is expanded.

Third Embodiment

Next, a third embodiment of the present invention will be described. In the third embodiment, a slide type variable resistor is applied to the detection unit of the first embodiment. Therefore, a configuration similar to that of the first embodiment will not be illustrated or described with the same reference numerals in the drawings.

Configuration of Detection Unit

Figure 10:
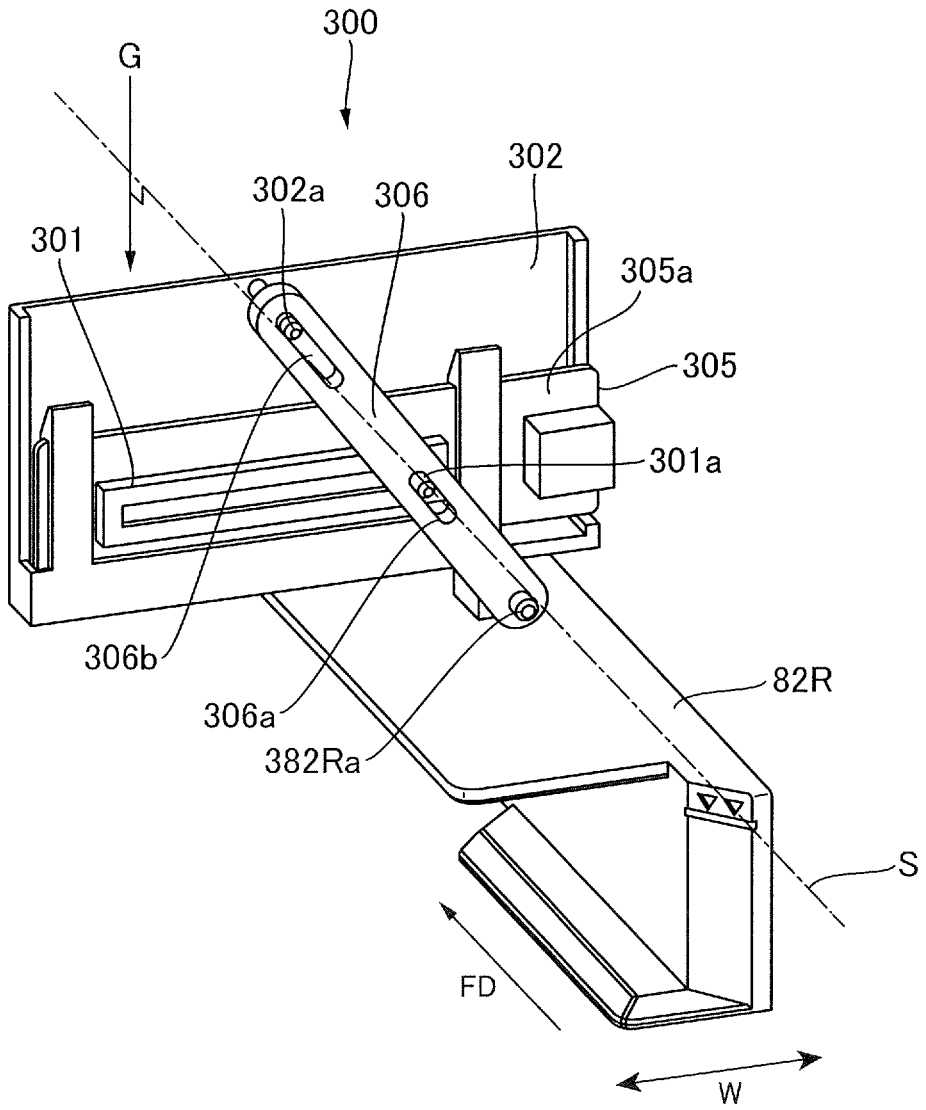
FIG. 10 is a perspective view illustrating a detection unit according to a third embodiment.
Figure 11:
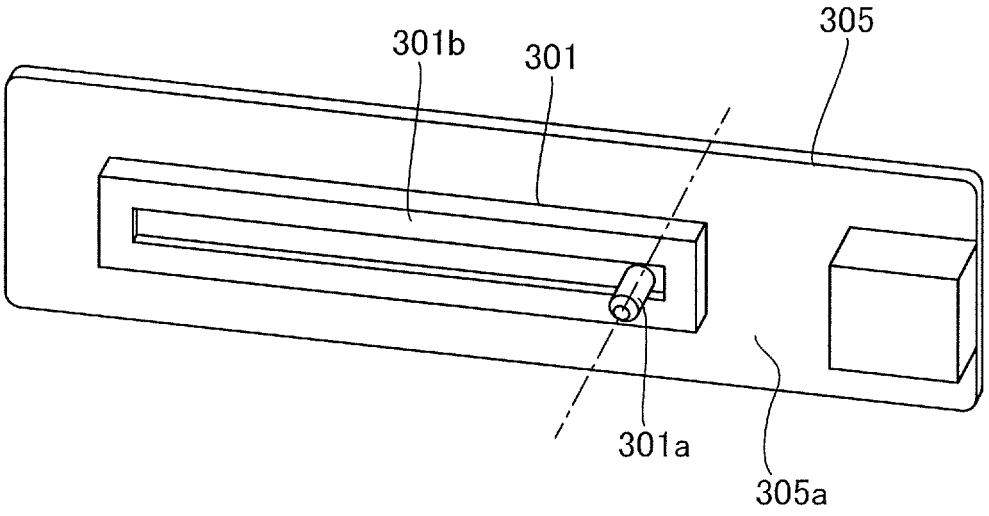
FIG. 11 is a perspective view illustrating a size detection sensor.

As illustrated in FIG. 10, a detection unit 300 includes a holder 302 fixed to the feeding frame, a printed substrate 305 retained by the holder 302, and a size detection sensor 301 connected to a pattern surface 305*a* of the printed substrate 305. As illustrated in FIG. 11, the size detection sensor 301 serving as a sensor includes a sensor body 301*b* electrically connected to the pattern surface 305*a* of the printed substrate 305, and a shaft member 301*a* slidably supported by the sensor body 301*b*.

A resistor (not illustrated) is disposed inside the sensor body 301*b*, and the resistance value of the resistor changes according to the position in the width direction W of the shaft member 301*a* serving as the moving unit. The size detection sensor 301 detects the resistance value serving as a detection value by converting the resistance value into a voltage, and the control portion 60 (refer to FIG. 1) determines the size of the sheet P according to the detected voltage.

In addition, as illustrated in FIG. 10, the detection unit 300 includes a sensor arm 306 serving as an interlocking portion whose one end portion is rotatably supported by a rotation shaft 382Ra provided on the side regulating plate 82R and a pivot member. The sensor arm 306 includes a long hole 306*b* through which a holder shaft 302*a* provided on the holder 302 passes, and a long hole 306*a* through which the shaft member 301*a* of the size detection sensor 301 passes. These long holes 306*a* and 306*b* extend in a longitudinal direction of the sensor arm 306, and the long hole 306*a* is disposed between the rotation shaft 382Ra and the long hole 306*b* in the longitudinal direction. The holder shaft 302*a* serving as a pivot shaft extends in the sheet feeding direction FD orthogonal to the width direction W and the direction of gravitational force G.

Also in the present embodiment, similar to the first embodiment, the axial center line S of the shaft member 301*a* extends in a direction orthogonal to the width direction W and the direction of gravitational force that is, the sheet feeding direction FD. In addition, the printed substrate 105 retained by the holder 302 is disposed so that the pattern surface 305*a* extends in parallel to the width direction W and the direction of gravitational force G That is, the size detection sensor 301 and the printed substrate 305 are disposed in a portrait orientation, so that the installation area of the detection unit 300 in a plan view can be reduced, and the apparatus can be downsized.

Furthermore, the detection unit 300 is disposed above the sheet feed tray 83 (refer to FIG. 1) in the open state, and more specifically, above the abutting position HP (refer to FIG. 1) between the sheet P supported by the sheet feed tray 83 and the pickup roller 81. Mainly, since foreign substances such as dust, fluff, paper dust, and fillers generated from the sheet P and the pickup roller 81 fall below the abutting position HP, the foreign substances are unlikely to enter a gap between the printed substrate 305 and the shaft member 301*a*. In addition, since the size detection sensor 301 and the printed substrate 305 are placed in a portrait orientation, the structure is such that the foreign substances are unlikely to enter the gap. As a result, it can reduce that the size detection sensor 301 detects erroneously by the influence of the foreign substances.

Operation of Side Regulating Plate and Detection Unit

Figure 12:
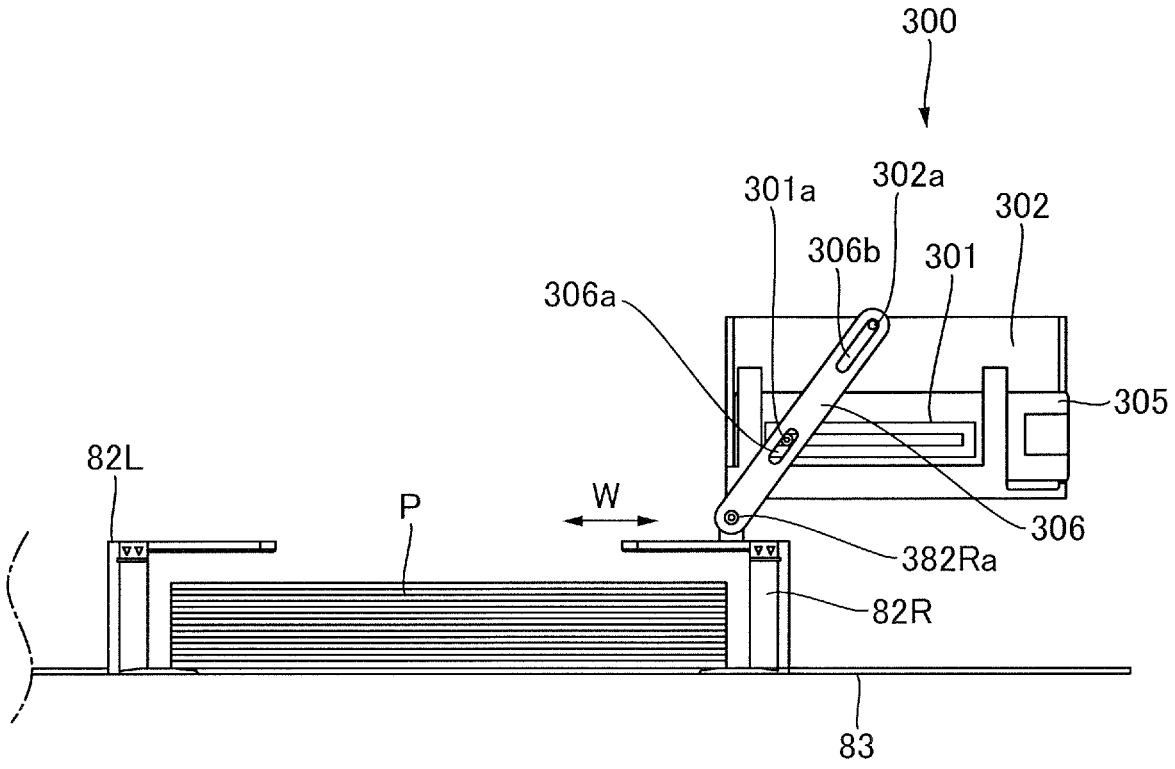
FIG. 12 is a side view illustrating an operation of a side regulating plate and the detection unit.

As illustrated in FIG. 12, when the side regulating plate 82R moves in the width direction W, the sensor arm 306 connected to the side regulating plate 82R also pivots about the holder shaft 302*a*. It is noted that in a condition in which the sensor arm 306 pivots, the long holes 306*a* and 306*b* slide on the shaft member 301*a* and the holder shaft 302*a*, respectively, and the pivoting of the sensor arm 306 is not hindered.

When the sensor arm 306 pivots, the shaft member 301*a* also slides in the width direction W. As described above, the sensor arm 306 constitutes an interlocking portion that moves the shaft member 301*a* in the width direction W in conjunction with the side regulating plate 82R.

The size detection sensor 301 converts a resistance value that changes according to the position of the shaft member 301*a* in the width direction W into a voltage, and the detected voltage is recognized as a size in the width direction of the sheet P (hereinafter referred to as width size) by the control portion 60 (refer to FIG. 1).

Figure 13:
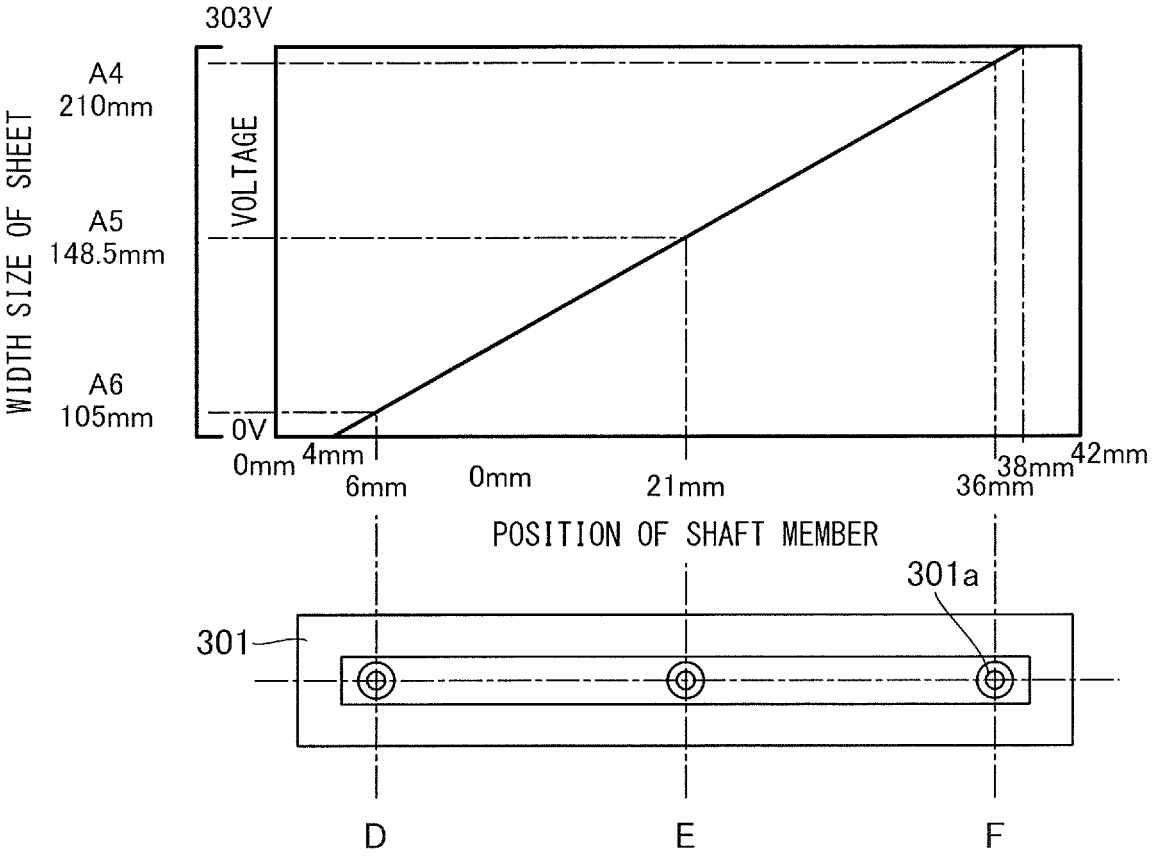
FIG. 13 is a graph illustrating a relationship between a position of the shaft member and the width size of the sheet.

FIG. 13 is a graph illustrating a relationship between the position (moving amount) of the shaft member 301*a* and the width size of the sheet P. A horizontal axis of the graph indicates the moving amount of the shaft member 301*a* with respect to the reference position, and a vertical axis indicates the voltage and the width size of the sheet P corresponding to the voltage. When the moving amount of the shaft member 301*a* increases, the voltage increases proportionally. Therefore, the size detection sensor 301 can detect the sheet width linearly.

Here, when the shaft member 301*a* is in a D position, that is, in a condition in which the moving amount is 6 mm, the detected width size of the sheet P is set to be equivalent to the A6 size (105 mm). When the shaft member 301*a* is in an E position, that is, in a condition in which the moving amount is 21 mm, the detected width size of the sheet P is set to be equivalent to the A5 size (148.5 mm). When the shaft member 301*a* is in an F position, that is, in a condition in which the moving amount is 36 mm, the detected width size of the sheet P is set to be equivalent to the A4 size (210 mm).

It is noted that the voltage is not displayed when the moving amount of the shaft member 301*a* is in the range of 0 mm to 4 mm and 38 mm to 42 mm. This is because the size detection sensor 301 is out of the usage area in terms of electrical characteristics. It is noted that the printer 1 according to the present embodiment supports sheets from A6 to A4, and a mechanical margin of 2 mm is provided for the moving amount of the shaft member 301*a* corresponding to a minimum width size and a maximum width size.

Since the pair of side regulating plates 82 operate symmetrically, the moving amount N of the side regulating plate 82R is half of a value obtained by subtracting the minimum width size from the maximum width size that can be detected by the size detection sensor 301. Here, the disposition of the holder shaft 302*a* is determined by the moving amount N and the moving amount of the shaft member 301*a*.

Figure 14:
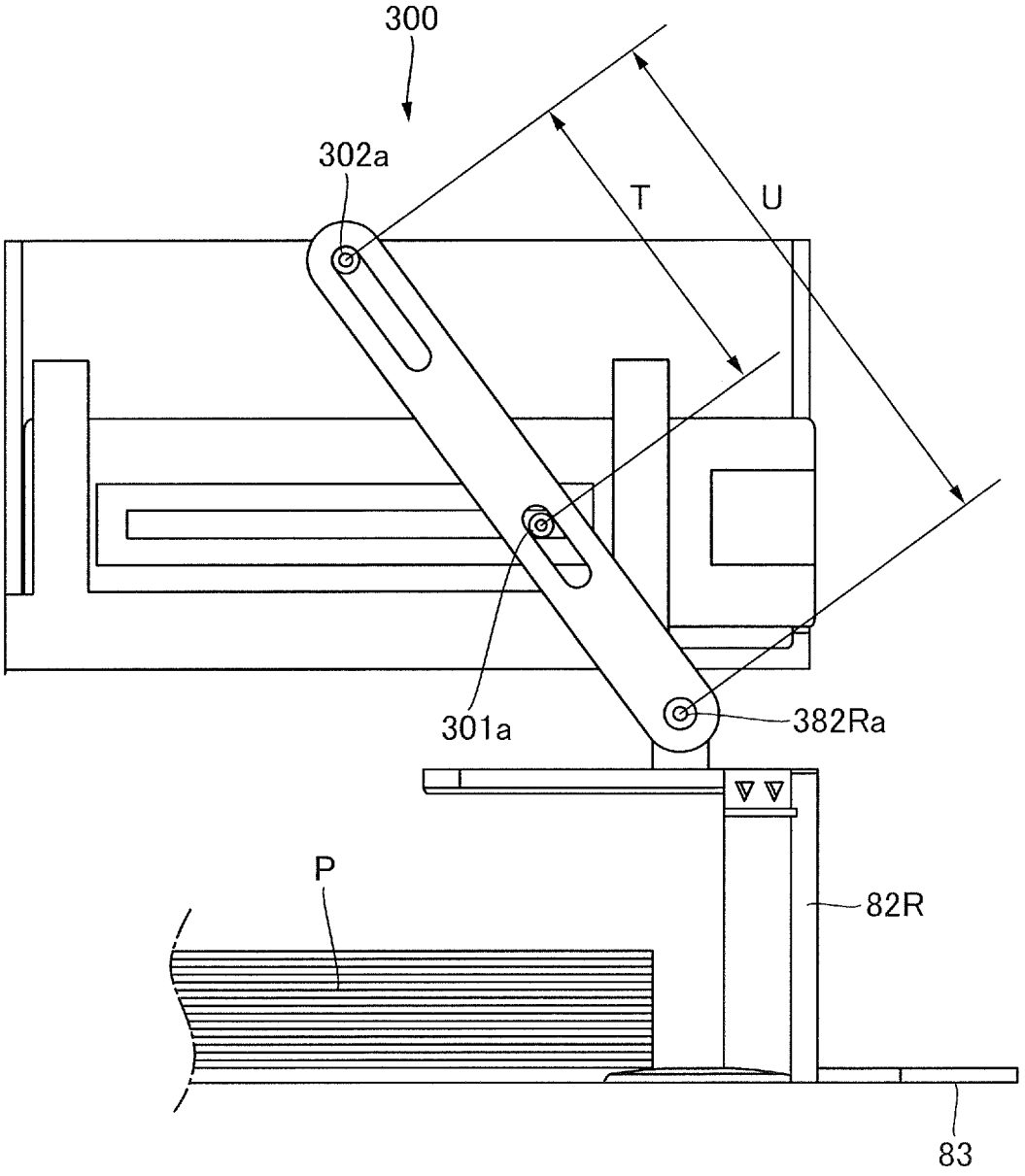
FIG. 14 is a side view for describing a disposition of a holder shaft.

As illustrated in FIG. 14, the distance between the centers of the holder shaft 302*a* and the rotation shaft 382Ra is a distance U, and the distance between the centers of the holder shaft 302*a* and the shaft member 301*a* is a distance T. The relationship between the distance U and the distance T is set to be the same as the ratio of the moving amount N and the moving amount of the shaft member 301*a*. For example, as set in FIG. 13, when the maximum width size is 210 mm of A4 size and the minimum width size is 105 mm of A6 size, the moving amount N of the side regulating plate 82R is 52.5 mm. Since the moving amount of the shaft member 301*a* is 30 mm, the position of the holder shaft 302*a* is determined so that the relationship between the distance U and the distance T is the same as the ratio of 52.5:30.

As described above, in the present embodiment, since the sensor gear or the rack portion is not provided, the number of parts can be reduced and the cost can be reduced, and the alignment of the shaft member 301*a* can be easily performed, so that the number of assembly steps can be reduced. In addition, the size detection sensor 301 and the printed substrate 305 are disposed in a portrait orientation, the installation area of the detection unit 300 in a plan view can be reduced, and the apparatus can be downsized.

Fourth Embodiment

Next, a fourth embodiment of the present invention will be described. In the fourth embodiment, a plurality of gears is added instead of the sensor arm of the detection unit of the third embodiment. Therefore, a configuration similar to that of the third embodiment will not be illustrated or described with the same reference numerals in the drawings.

Configuration of Detection Unit

Figure 15A:
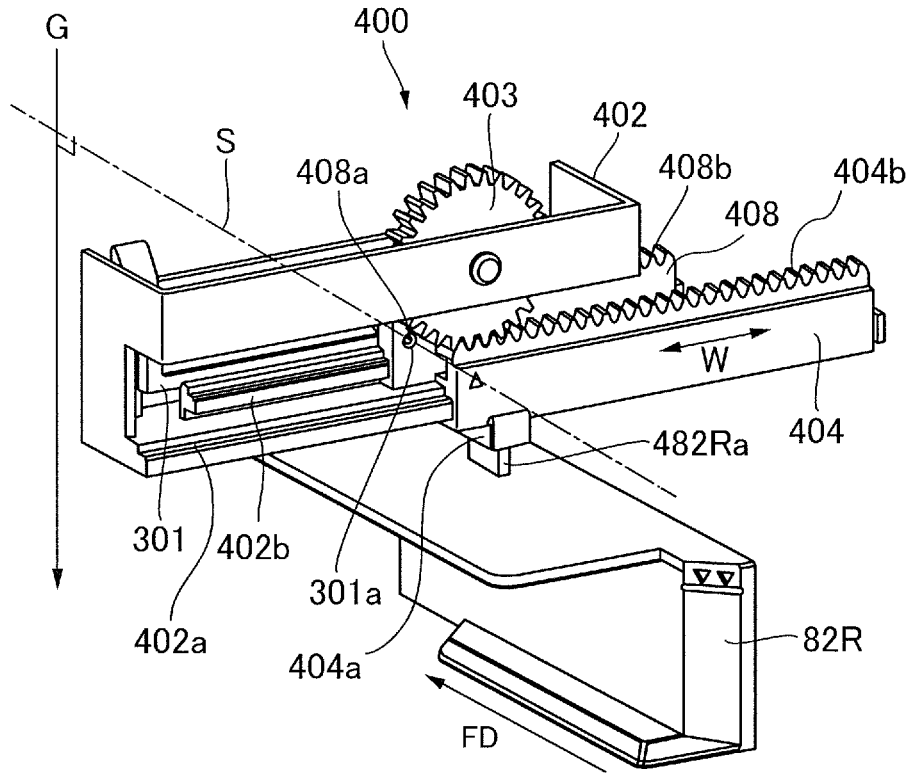
FIG. 15A is a front perspective view illustrating a detection unit according to a fourth embodiment.
Figure 15B:
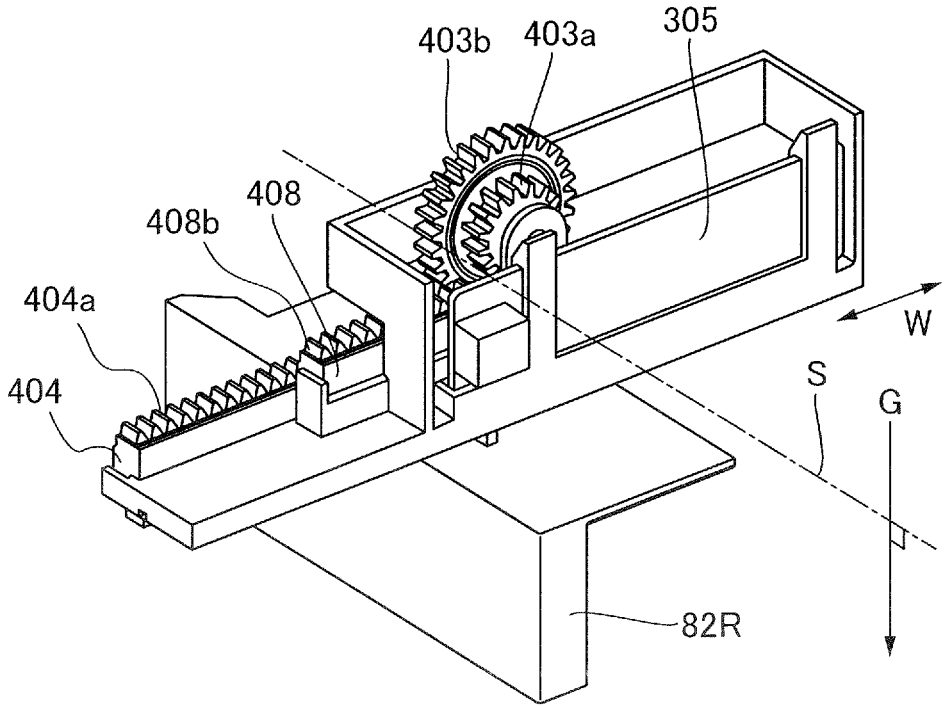
FIG. 15B is a rear perspective view illustrating the detection unit.
Figure 16:
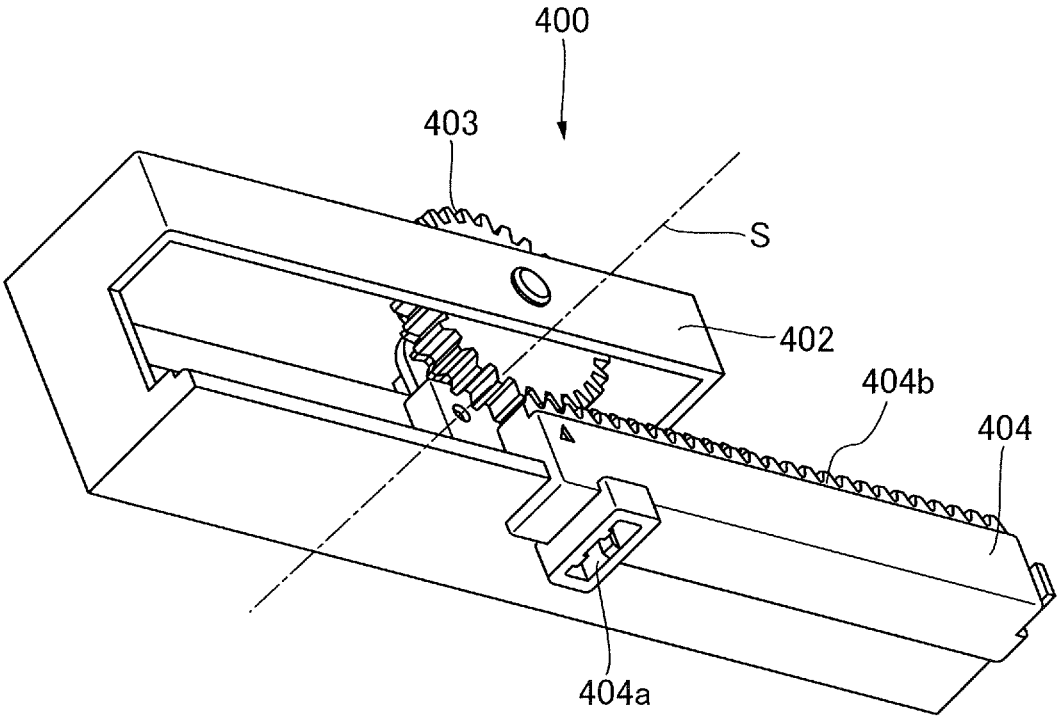
FIG. 16 is a bottom perspective view illustrating the detection unit.

As illustrated in FIGS. 15 and 16, a detection unit 400 includes a holder 402 fixed to the feeding frame, the printed substrate 305 retained by the holder 402, and the size detection sensor 301 connected to the pattern surface 305*a* of the printed substrate 305. In addition, the detection unit 400 includes a first slider 404 and a second slider 408, which are supported so as to be slidable in the width direction W along a first guide rail 402*a* and a second guide rail 402*b* formed in the holder 402, respectively, and an idler step gear 403. A protruding portion 482Ra is formed on the upper portion of the side regulating plate 82R, and the protruding portion 482Ra is engaged with an engagement portion 404*a* protruding downward from the lower portion of the first slider 404.

Rack portions 404*b* and 408*b* are formed in the first slider 404 and the second slider 408, respectively. The rack portion 404*b* serving as a first rack portion is provided on the first slider 404 integral with the side regulating plate 82R and extends in the width direction W. The idler step gear 403 is rotatably supported by the holder 402, and includes a large diameter gear 403*b* that can mesh with the rack portion 404*b* of the first slider 404 and a small diameter gear 403*a* that can mesh with the rack portion 408*b* of the second slider 408. The large diameter gear 403*b* and the small diameter gear 403*a* rotate integrally. That is, the idler step gear 403 serving as a gear portion includes a plurality of gears that decelerate a driving force transmitted from the rack portion 404*b* and transmit the driving force to the second slider 408.

In addition, the second slider 408 serving as a second rack portion includes a hole 408*a* fitted into the shaft member 301*a* of the size detection sensor 301, and when the second slider 408 moves in the width direction W, the shaft member 301*a* also moves in the width direction W.

Also in the present embodiment, similar to the first embodiment, the axial center line S of the shaft member 301*a* extends in a direction orthogonal to the width direction W and the direction of gravitational force that is, the sheet feeding direction FD. In addition, the printed substrate 305 retained by the holder 402 is disposed so that the pattern surface 305*a* extends in parallel to the width direction W and the direction of gravitational force G That is, the size detection sensor 301, the idler step gear 403, and the printed substrate 305 are disposed in a portrait orientation, so that the installation area of the detection unit 400 in a plan view can be reduced and the apparatus can be downsized.

Operation of Side Regulating Plate and Detection Unit

Figure 17:
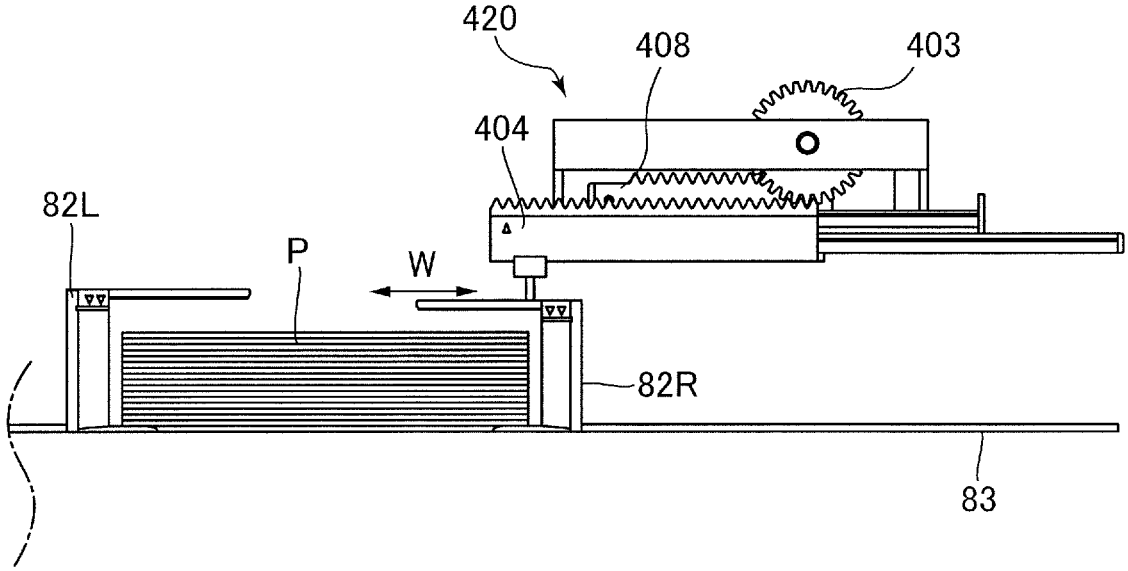
FIG. 17 is a side view illustrating an operation of a side regulating plate and the detection unit.

As illustrated in FIG. 17, when the side regulating plate 82R moves in the width direction W, the first slider 404 connected to the side regulating plate 82R also moves in the width direction W. The idler step gear 403 is rotated by the rack portion 404*b* formed in the first slider 404, and the driving force is decelerated by the idler step gear 403 and transmitted to the second slider 408.

When the second slider 408 driven by the small diameter gear 403*a* of the idler step gear 403 moves in the width direction W, the shaft member 301*a* fitted into the hole 408*a* of the idler step gear 403 also moves in the width direction W. As described above, the first slider 404, the idler step gear 403, and the second slider 408 constitute an interlocking portion 420 that moves the shaft member 301*a* in the width direction W in conjunction with the side regulating plate 82R.

The size detection sensor 301 converts a resistance value that changes according to the position of the shaft member 301*a* in the width direction W into a voltage, and the detected voltage is recognized as a size in the width direction of the sheet P (hereinafter referred to as width size) by the control portion 60 (refer to FIG. 1).

For example, as set in FIG. 13, when the maximum width size is 210 mm of A4 size and the minimum width size is 105 mm of A6 size, the moving amount N of the side regulating plate 82R is 52.5 mm. When the moving amount of the shaft member 301*a* is 30 mm similar to the third embodiment, the deceleration ratio of the idler step gear 403 is set to 30/52.5. As a result, even in the configuration in which the shaft member 301*a* is slid by the rack portion and the idler step gear, the moving amount of the shaft member 301*a* and the second slider 408 can be configured to be smaller than the moving amount N of the side regulating plate 82R.

In addition, since the idler step gear 403 having a lower height than that of the sensor arm 306 of the third embodiment is used, the height of the detection unit 400 is suppressed even when the moving amount N of the side regulating plate 82R increases, and the apparatus can be downsized. In addition, since the alignment of the first slider 404 and the second slider 408 is unnecessary, the number of assembly steps can be reduced.

It is noted that in any of the above-described embodiments, the detection unit detects the size of the sheet P based on the position of the side regulating plate 82R, and is not limited thereto. For example, a trailing end regulating plate that regulates the position of a trailing edge of the sheet P stacked on the sheet feed tray 83 may be provided, and the size of the sheet P may be detected based on the position of the trailing end regulating plate. In this case, the detection unit is connected to the trailing end regulating plate.

In addition, in any of the above-described embodiments, the detection unit detects the size of the sheets P stacked on the sheet feed tray 83 provided on the lower portion of the printer 1, and is not limited thereto. For example, a manual feed tray may be provided on the side of the printer 1 and the detection unit may detect the size of the sheets stacked on the manual feed tray. For example, an image reading apparatus may be provided on the upper portion of the printer 1, and the detection unit may detect the size of the document stacked on the document tray of the image reading apparatus.

In any of the above-described embodiments, the variable resistor whose resistance value is variable is applied to the size detection sensor, and is not limited thereto. For example, a rotary encoder having a photo sensor and a lattice disk having a plurality of slits in the circumferential direction, and a linear encoder having a photo sensor and a scale having a plurality of scales in a linear direction may be applied to the size detection sensor. In addition, a magnetic sensor may be used instead of the photo sensor.

In addition, in any of the above-described embodiments, the printed substrate is used for the detection unit, and the type of the printed substrate is not limited. Any type of printed substrate such as a rigid type or a flexible type may be used. In addition, the size detection sensor may not be directly attached to the pattern surface of the printed substrate, and may be connected to the pattern surface via a conductor line or the like.

In addition, in any of the above-described embodiments, the electrophotographic system printer 1 is described, and the present invention is not limited thereto. For example, the present invention can be applied to an ink jet image forming apparatus that forms an image on a sheet by ejecting ink liquid from a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-040904, filed Mar. 6, 2019, which is hereby incorporated by reference herein in its entirety.

What is claimed is:

1. A sheet feeding apparatus comprising:

a supporting portion configured to support a sheet;

a regulating unit supported to be movable in a first direction, and configured to regulate a position of an end portion, in the first direction, of the sheet supported by the supporting portion;

a feed unit configured to feed the sheet supported by the supporting portion;

a variable resistor comprising a rotary member configured to be rotated by a movement of the regulating unit in the first direction, and having a resistance value changing linearly according to a rotational phase of the rotary member;

an interlocking portion configured to rotate the rotary member in conjunction with the regulating unit; and a substrate comprising a pattern surface to which the variable resistor is connected, wherein an axial center line of the rotary member extends in a second direction orthogonal to the first direction and a direction of gravitational force, the substrate is disposed such that the pattern surface extends in parallel with the first direction and the direction of gravitational force in a state where the feeding unit is feeding the sheet supported on the supporting portion, the rotary member is a shaft member, the interlocking portion comprises a rack portion extending in the first direction, and a gear portion fixed to the shaft member and meshing with the rack portion, and the rack portion is disposed above the regulating unit.

2. The sheet feeding apparatus according to claim 1, wherein the variable resistor is disposed above the supporting portion.

3. The sheet feeding apparatus according to claim 1, wherein the variable resistor is disposed above an abutting position where the sheet supported by the supporting portion and the feed unit abut each other.

4. The sheet feeding apparatus according to claim 1, wherein the gear portion comprises a plurality of gears decelerating a driving force transmitted from the rack portion and transmitting the driving force to the rotary member.

5. The sheet feeding apparatus according to claim 1, wherein the first direction is a width direction orthogonal to a sheet feeding direction.

6. An image forming apparatus comprising:

the sheet feeding apparatus according to claim 1; and an image forming unit configured to form an image on a sheet fed by the sheet feeding apparatus.

7. The image forming apparatus according to claim 6, wherein the supporting portion is provided on a lower portion of the image forming apparatus.

* * * * *